US007045959B2

(12) United States Patent
Xu et al.

(10) Patent No.: US 7,045,959 B2
(45) Date of Patent: May 16, 2006

(54) SPIRAL COLD ELECTRODE FLUORESCENT LAMP

(75) Inventors: Baodu Xu, Shanghai (CN); Yanhua Tu, Shanghai (CN)

(73) Assignee: Shanghai Xiang Shan Industry LLC, Shanghai (CN)

( * ) Notice: Subject to any disclaimer, the term of this patent is extended or adjusted under 35 U.S.C. 154(b) by 86 days.

(21) Appl. No.: 10/769,053

(22) Filed: Jan. 30, 2004

(65) Prior Publication Data

US 2005/0168146 A1 Aug. 4, 2005

(51) Int. Cl.
*H01J 17/24* (2006.01)

(52) U.S. Cl. ..... 313/558; 553/631

(58) Field of Classification Search ..... 313/558, 313/559, 553, 631, 634, 17
See application file for complete search history.

(56) References Cited

U.S. PATENT DOCUMENTS 4,312,669 A * 1/1982 Boffito et al. ..... 420/422
4,694,215 A * 9/1987 Hofmann ..... 313/44
5,015,917 A * 5/1991 Nigg ..... 315/56
5,239,229 A * 8/1993 Bouchard ..... 313/558
5,572,088 A * 11/1996 Aizawa et al. ..... 313/491
5,898,272 A * 4/1999 Mohacsi ..... 313/632
6,000,982 A * 12/1999 Nakamura et al. ..... 445/51
6,064,155 A * 5/2000 Maya et al. ..... 315/56
6,452,326 B1 * 9/2002 Ge et al. ..... 313/493
6,630,780 B1 * 10/2003 Yan ..... 313/493
6,739,737 B1 * 5/2004 Yu ..... 362/300
6,828,719 B1 * 12/2004 Huang et al. ..... 313/486
2003/0223230 A1 * 12/2003 Li ..... 362/216

* cited by examiner

*Primary Examiner*—Karabi Guharay
*Assistant Examiner*—Anthony Perry
(74) *Attorney, Agent, or Firm*—Raymond Y. Chan; David & Raymond

(57) ABSTRACT

A light tube for a cold electrode fluorescent lamp includes a light tube body, a first electrode and a second electrode disposed in the light tube body and an activated gas absorber. The light tube body contains inert gas, mercury substance and a layer of phosphor coating on its inner surface. The second electrode is adapted for electrically connecting to the an electric terminal for emitting electrons to excite the mercury substance for conducting the electrons to the first electrode as an electric loop, wherein the excited mercury substance emits ultra violet rays causing the phosphor coating to generate visible light. The activated gas absorber is gas absorber made of zirconium-vanadium-iron alloy which can be activated at an activation temperature substantially lower than 900 degrees Celsius, preferably 390 degrees Celsius, to provide stronger oxygenic gas absorption ability while reducing the manufacturing steps and cost.

19 Claims, 11 Drawing Sheets

SPIRAL COLD ELECTRODE FLUORESCENT LAMP

BACKGROUND OF THE PRESENT INVENTION

1. Field of Invention

The present invention relates to a spiral cold electrode fluorescent lamp, and more particularly to a spiral electrode fluorescent lamp whose second electrode is coated with a layer of gas absorbent for slowing the decaying rate of the same.

2. Description of Related Arts

A compact fluorescent lamp (CFL) is widely used for lightening. A conventional CFL includes a light tube, spread with a phosphor coating on its inner surface, containing inert gas and mercury substance, in the form of mercury vapor or liquid mercury. The light tube is enclosed with caps at its two ends, at which a first and second electrodes are disposed therein. When enough electric voltage is applied to the first and second electrodes, the second electrode emits electrons and causes the mercury to discharge, thereby conducting the electric current to the first electrode. In the course of discharge, the mercury emits ultra violet rays which excite the phosphor coating to generate visible light. The second electrode is usually shaped as a wire in a dimension of millimeter. In order to electrically excite the mercury to emit ultra violet rays, the second electrode is usually required to function at a temperature about 800 degrees Celsius.

A cold electrode fluorescent lamp (CCFL) has a basic structure similar to CFL in the sense that they all need a light tube with an inner layer of phosphor coating that contains inert gas and mercury substance, and a second electrode electrically connected to a power source for exciting the mercury. The CCFL is different from the CFL in the sense that the second electrode of CCFL has a larger surface area and lower functioning temperature. The second electrode of CCFL is usually shaped as a single or multiple layers of plates, such that its surface area is larger than the wire-shaped second electrode of CFL. Additionally, only a temperature about 100 degrees Celsius is required for the second electrode of CCFL to function. This is how the name "cold electrode" is given, comparing the traditional second electrode for CFL. Because the cold electrode functions at a lower temperature, the life span of CCFL usually lasts longer than its comparative models of CFL. Moreover, the CCFL can better survive an impact force than the CFL does, because it is easier for the impact force to disconnect the wire-shaped second electrode of CFL from the power source than to disconnect the plate-shaped second electrode from the same.

One phenomenon causes the cold electrode to decay is its oxidation problem. Besides inert gas and mercury, the light tube always contains air either residually left in the light tube, or subsequently entered from the sealing into the same. During the manufacturing process, gases such as $O_2$, CO, $CO_2$ and $H_2O$, may be existed in the light-tube and such residual active gases would facilitate the oxidation of the cold electrode. The oxidation decreases the intensity of electrons emitted from the cold electrode, and therefore reducing the luminance of the CCFL. Until the oxidation develops to a certain point, the cold electrode can no longer emit electrons with enough intensity to excite the mercury. At this point, the CCFL can no longer serve its purpose of illumination.

One solution to cope with the oxidation problem is to place a gas absorber in the light tube to absorb the oxygenic gas. The less the oxygenic gas exists in the light tube, the slower the cold electrode oxidizes, the longer the cold electrode is able to emit electrons with sufficient intensity. The life span of the CCFL is therefore increased. For example, a conventional color display may adopt a second electrode partially coated with a layer of gas absorbent based on barium alloy; a filament light bulb may contain gas absorber having phosphor as its predominating constitutient; and some high-end products of CFL include gas absorber made of alloy containing zirconium and aluminum. These various types of gas absorber serve the same purpose of absorbing oxygenic gas in order to lengthen the life span of the lights.

One shortcoming of the conventional gas absorber is its insufficient capability of absorbing the oxygenic gas. The gas absorber performs usually at an activation temperature as high as 900 degrees Celsius. The high activation temperature works in both ways. Although it helps the absorber to absorb the oxygenic gas, it facilitates the oxidizing reaction of the second electrode. However, it also requires an additional expensive manufacturing equipments to activate the gas absorber at 900 degrees Celsius to form activated gas absorber in order to absorb oxygenic gas at normal temperature. As a result, the cost of manufacturing the CCFL is inevitably increased and processing of making the same is likewise complicated.

Thus, what is needed is a CCFL containing a gas absorber in its light tube that has an improved capability of absorbing oxygenic gas and lower requirement for working temperature in order to lengthen the life span of the second electrode of CCFL.

SUMMARY OF THE PRESENT INVENTION

An objective of the present invention is to provide a light tube for cold electrode fluorescent lamp that includes a zirconium-vanadium-iron-based gas absorber, which is able to be activated at an activation temperature substantially lower than 900 degrees Celsius and has better efficiency of gas absorption than conventional ones.

Another objective oft he present invention is to provide a light tube for cold electrode fluorescent lamp that includes a zirconium-vanadium-iron-based gas absorber, which is able to be activated at an activation temperature about 390 degrees Celsius, that is during the general gas discharging step of its manufacturing process, so as to minimize its manufacturing processes and cost and to eliminate those expensive heating equipments.

Another objective of the present invention is provide a light tube for cold electrode fluorescent lamp whose second electrode is made in various shapes for enlarging a surface area of the second electrode in order to enhance the second electrode in terms of resisting oxidation and surviving an impact forced applied to the light tube.

Another objective of the present invention is to provide a light tube for cold electrode fluorescent lamp that is made in various shapes in order to reduce a space occupied by the same.

Another objective of the present invention is to provide a cold electrode fluorescent lamp that includes a housing air-tightly attached to an igniter casing extended from a base for maintaining heat therein in order to warm the second electrode.

Another objective of the present invention is to provide a cold electrode fluorescent lamp that includes a housing attached to an igniter casing extended from a base, wherein an air passage is formed between the housing and the igniter casing for balancing pressure within and without the housing.

Another objective of the present invention is to provide a cold electrode fluorescent lamp that includes an igniter for driving the cold electrode to a functioning stage.

Another objective of the present invention is to provide a cold electrode fluorescent lamp that includes a housing made of colors for effects of colorful illumination.

In order to accomplish the above objectives, the present invention provides a light tube for a cold electrode fluorescent lamp comprising: a light tube body, having a first end portion and second end portion, containing inert gas, mercury substance and a layer of phosphor coating on an inner surface of the light tube body; a first electrode disposed at the first end portion in the light tube body and a second electrode disposed at the second end portion in the light tube body, wherein the first and second electrodes are adapted for connecting to terminals of high frequency alternate current (AC) electric power source for emitting electrons to excite the mercury substance for conducting the electrons to the other electrode as a electric loop, wherein the excited mercury substance emits ultra violet rays causing the phosphor coating to generate visible light; and a gas absorber, made of zirconium-vanadium-iron alloy, formed at the second electrode for absorbing oxygenic gas.

These and other objectives, features, and advantages of the present invention will become apparent from the following detailed description, the accompanying drawings, and the appended claims.

DETAILED DESCRIPTION OF THE PREFERRED EMBODIMENT

Figure 1:
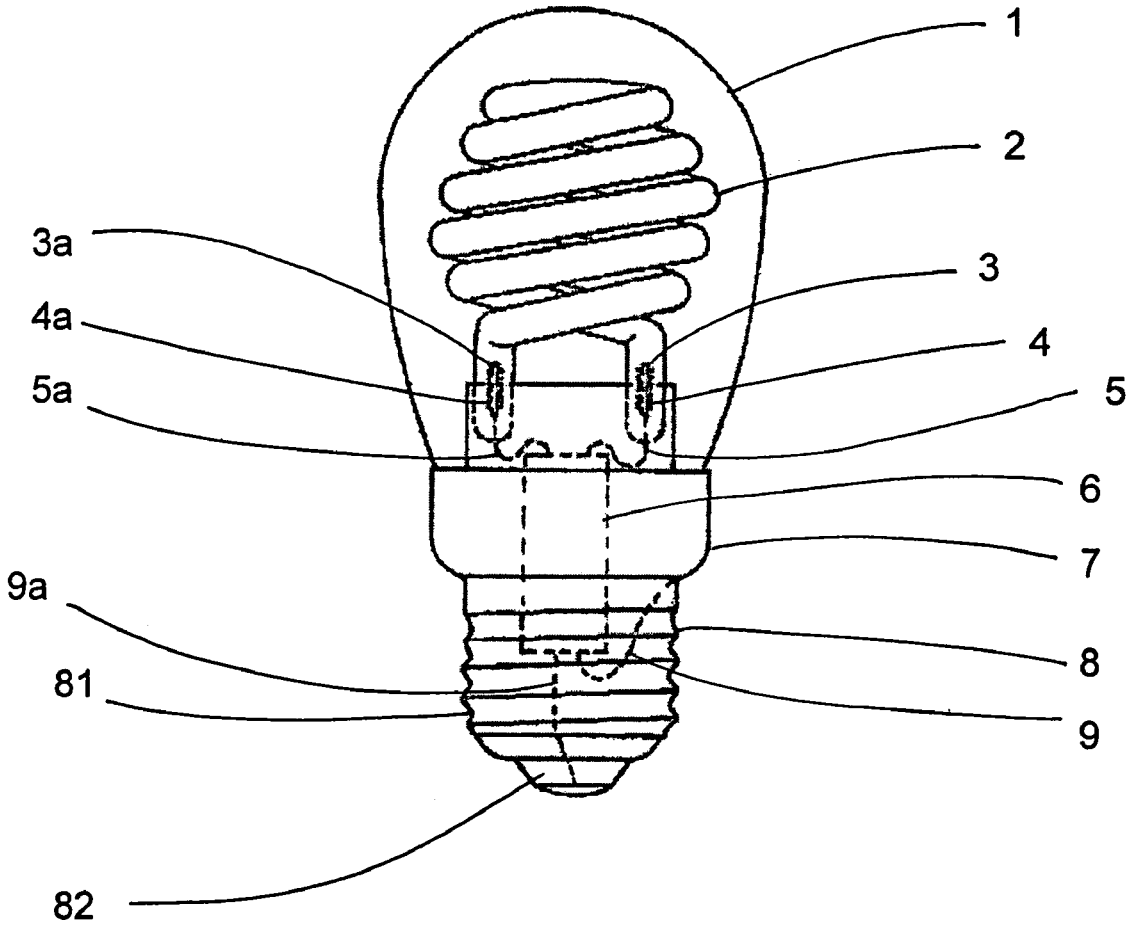
FIG. 1 is a schematic view of a CCFL light bulb that includes an improved gas absorber in its light tube according to a preferred embodiment of the present invention.

Referring to FIG. 1, a CCFL light bulb that includes a gas absorber is illustrated according to a preferred embodiment of the present invention. The light bulb comprises a base 8, an igniter casing 7 extended from the base 8, an igniter 6 disposed in the igniter casing 7, electrodes including a first electrode 3*a* and a second electrode 3, a gas absorber agent 4 and 4*a*, light tube 2 containing the electrodes 3, 3*a* and gas absorbers 4, 4*a*, and a housing 1 attached to the igniter casing 7 for enclosing the light tube 2 therein.

The base 8 has a threaded side wall 81, having a cylindrical shape, and a tapered bottom end 82, adapted for securing to a compatible socket for electrically connecting to an alternate current (AC) electric power source. The threaded side wall 81 and the tapered end 82 are made of conductive material for electrically connecting to the socket. The tapered end 82 and the side wall 81 are so insulated that they may electrically be connected to terminals of the socket respectively.

The igniter casing 7 extends from the base 8, in which a cavity is formed for receiving various components. The igniter casing 7 is made integrally with the base 8 for ease of manufacturing. It is noted that the casing 7 may also be made separately from the base 8, and then attached thereto via traditional connection means.

The igniter 6, which is disposed in the igniter casing 7 for transforming voltage to a sufficient level to drive the first and second electrodes 3*a*, 3 to function, is electrically connected to the tapered end 82 and the side wall 81 of the base 8 through first wires 9*a* and 9, respectively. When the base 8 is secured on the socket, the igniter 6 may be triggered upon a turned-on switch to tap the igniter 6 to the electric power source. The igniter 6 is further electrically connected to the first and second electrodes 3*a*, 3 by second wires 5 and 5*a* extending into the light tube 3 and 3*a*.

The light tube 2 has a spiral shape with two end portions horizontally extending toward the igniter casing 7. The spiral shape minimizes the space the light tube 2 occupies so that the CCFL light bulb can be made compact. The light tube 2, having a phosphor coating spread on its inner surface, contains inert gas, such as neon, argon, and mercury substance. The mercury substance may be in various forms, such as mercury vapor, liquid mercury and amalgam.

The first and second electrodes 3*a* and 3, disposed at the end portions of the light tube 2, are electrically connected to the terminals of the socket via the second wires 5 and 5*a*, the igniter 6, the first wires 9 and 9*a*, and the side wall 81 and tapered end 82 of the base 8. Particularly, the first and second electrodes 3*a* and 3 are electrically connected to the high frequency AC electric power source, to from an electric loop. When the loop is switched on, the igniter 6 boosts the voltage of the electric current received from the first wires 9 and 9*a* to excite the second electrode 3 to emit electrons. The electrons emitting from the second electrode 3 further excite the mercury contained in the light tube 2 to discharge electrons, thereby conducting the electric current to the first electrode 3*a*. In the course of mercury discharge, ultra violet rays are emitted to cause the phosphor coating to generate visible light.

The gas absorbers 4 and 4*a* are activated gas absorbers formed at the ends of electrodes 3 and 3*a* connecting to the second wires 5 and 5*a* to absorb oxygenic gas, such as $O_2$, CO, $CO_2$ and $H_2O$.

The gas absorbers made of alloy containing zirconium, vanadium and iron are capable of being activated during the manufacturing process at an activation temperature about 390 degrees Celsius to form the activated gas absorbers 4 and 4*a* which can absorb oxygenic gas at normal temperature. In other words, no additional expensive heating equipments are required to activate the zirconium-vanadium-iron gas absorber to form the activated gas absorbers 4 and 4*a* at such a higher temperature like 900 degrees Celsius as required for the traditional barium-based gas absorbers. This advantage greatly saves the costs for manufacturing the CCFL and simplifies the manufacturing process, because no such additional components are required. Moreover, the activated gas absorbers 4 and 4*a* provide stronger oxygenic gas absorption ability and render lower oxidizing rate of second electrode 3 than the traditional ones. The activated gas absorbers 4 and 4*a* are capable of being made by various processes. For examples, they may be coated with a layer of zirconium-vanadium-iron alloy on the surfaces of electrodes 3 and 3*a* by means of sputtering and disposition or they may be integrally formed with the electrodes 3 and 3*a* as an entirety.

The housing 1, enclosing the light tube 2, is attached to the igniter casing 7 for protection of the same. The sealing between the housing 1 and the igniter casing 7 may be air-tight such that the chances air entering from outside of housing 1 into the light tube 2 to fuel the second electrode 3 oxidation is reduce. Accordingly, the housing 1 is able to keep the light tube 2 warm, as it is functioning. As an alternative, a gas passage may be formed between the interface of the housing 1 and igniter casing 7 in order to balance the pressure within and without the housing 1 and facilitate heat dissipation. The housing 1 may be colored with red, green or blue, the three basic colors, or any other colors, for purposes of colorful illumination. It is noted that the housing 1 can be made of material such as glass or plastic to achieve the above-mentioned effects.

Figure 2:
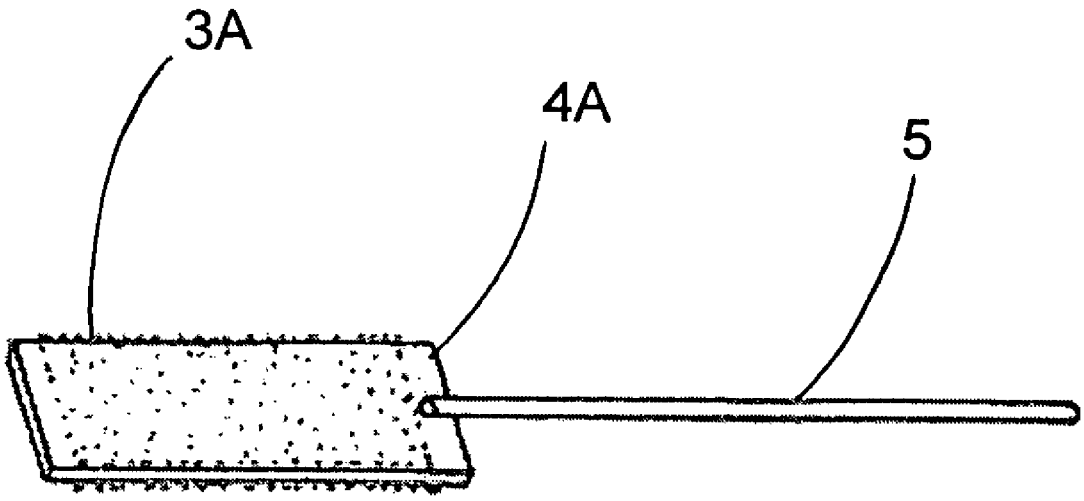
FIG. 2 is a perspective view of the second electrode of CCFL according to the preferred embodiment of the present invention.
Figure 3:
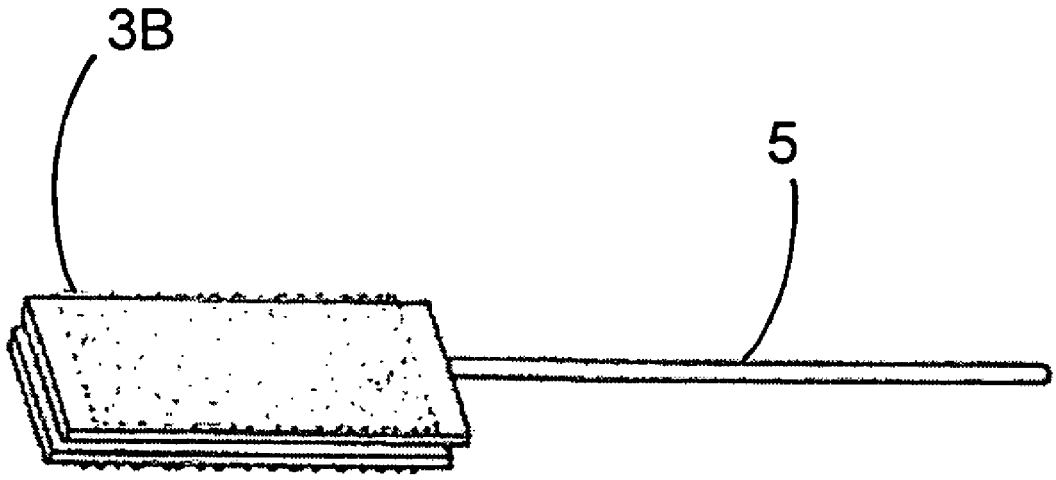
FIG. 3 is a perspective view of an alternative of second electrode according to the preferred embodiment of the present invention.
Figure 4:
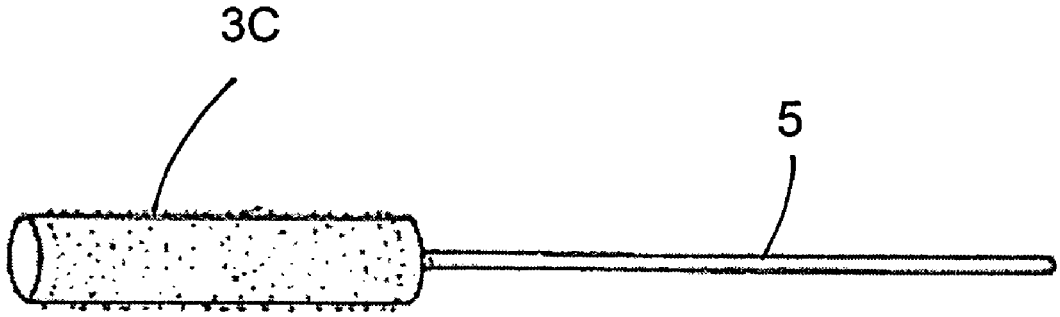
FIG. 4 is a perspective view of another alternative of second electrode according to the preferred embodiment of the present invention.
Figure 5:
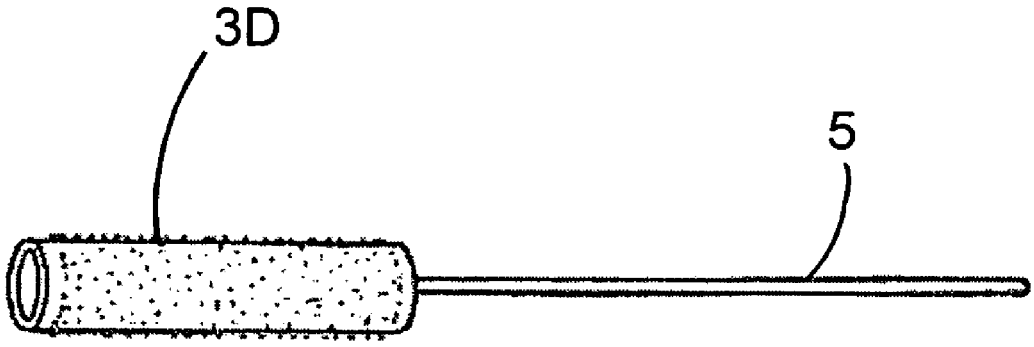
FIG. 5 is a perspective view of another alternative of second electrode according to the preferred embodiment of the present invention.
Figure 6:
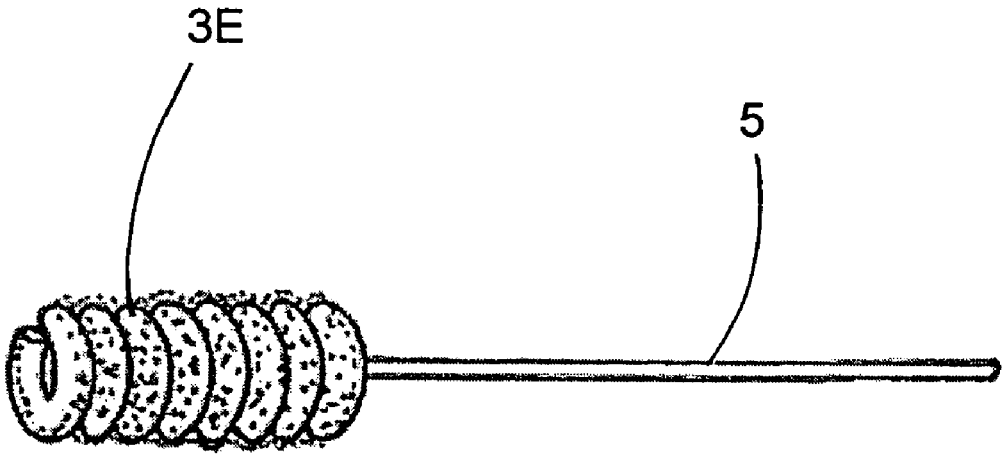
FIG. 6 is a perspective view of another alternative of second electrode according to the preferred embodiment of the present invention.
Figure 7:
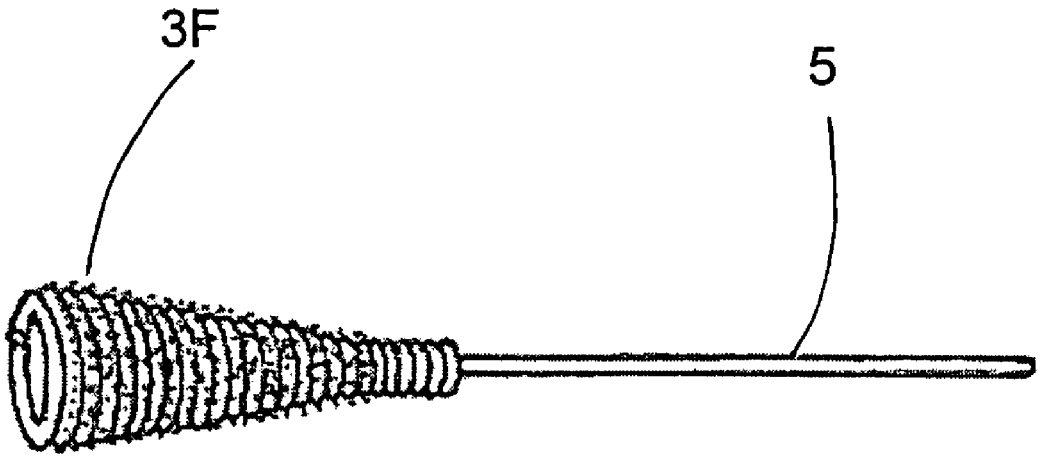
FIG. 7 is a perspective view of another alternative of second electrode according to the preferred embodiment of the present invention.

Referring to FIGS. 2 through 7, variously shaped second electrodes are illustrated. In FIG. 2, the second electrode 3A is shaped as a single layer plate on which the gas absorber 4A is formed. In FIG. 3, as an alternative, the second electrode 3B is shaped as a plate with two layers sandwiching the second wire 5. In FIG. 4, as another alternative, the second electrode 3C is shaped as a rod with the second wire 5 attached to its end. In FIG. 5, as another alternative, the second electrode 3D is made as a tube having a cylindrical side wall defining an inner hollow portion to the end of which the second wire 5 is attached. In FIG. 6, as another alternative, the second electrode 3E is shaped as a spiral that has a constant cross-section along the longitudinal direction to the end of which the second wire 5 is attached. In FIG. 7, as another alternative, the second electrode 3F is shaped as a spiral that has a cross-section varying along the longitudinal direction to the end of which the second wire 5 is attached. The various shapes enlarge the surface area of the second electrode 3 (3A–3F) for better emitting electrons to excite the mercury in the light tube 2. Additionally, the enlarged surface makes the second electrode less susceptible to oxidation than the conventional ones, i.e., wire-shaped second electrodes, due to their rather small surface area. Furthermore, the various shapes enhance the second electrodes' capability to survive an impact force and still keep their structures intact.

Figure 8:
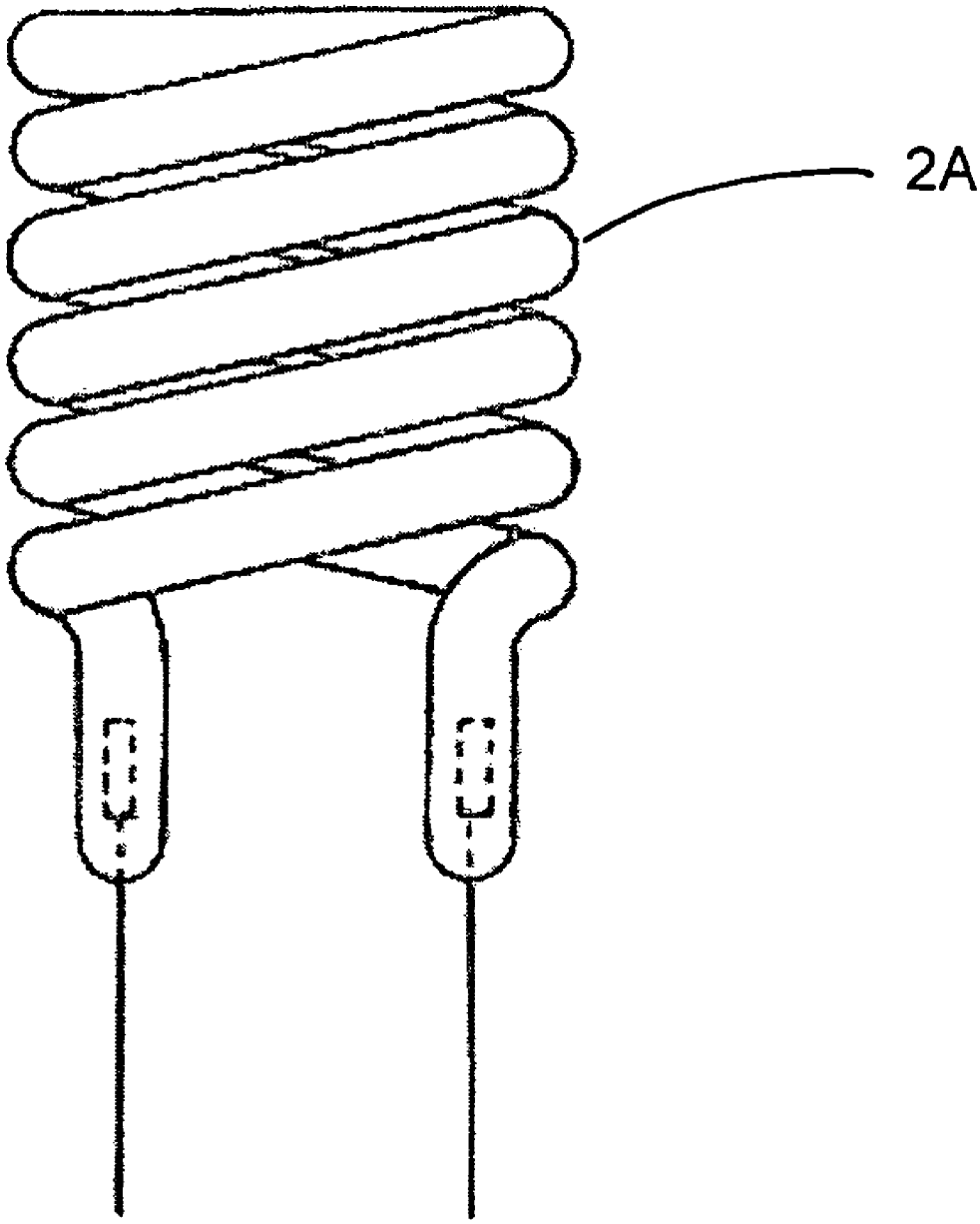
FIG. 8 is a perspective view of the light tube of CCFL according to the preferred embodiment of the present invention.
Figure 9:
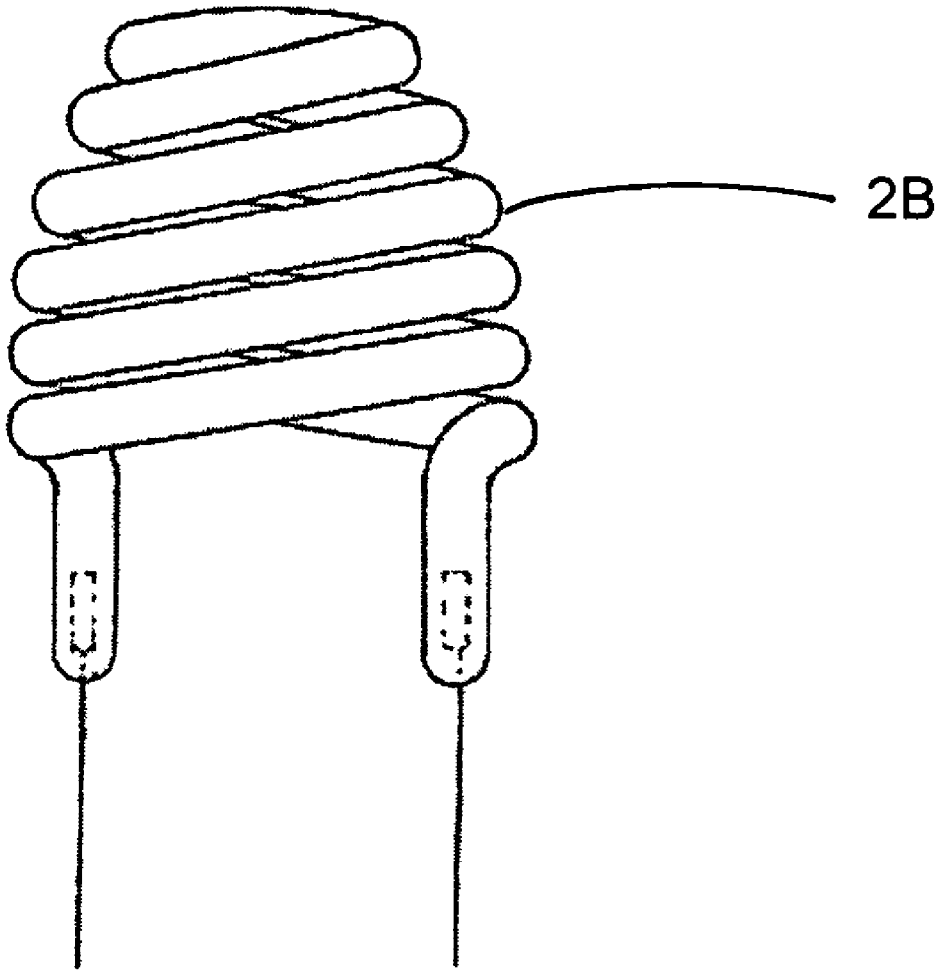
FIG. 9 is a perspective view of an alternative of light tube according to the preferred embodiment of the present invention.
Figure 10:
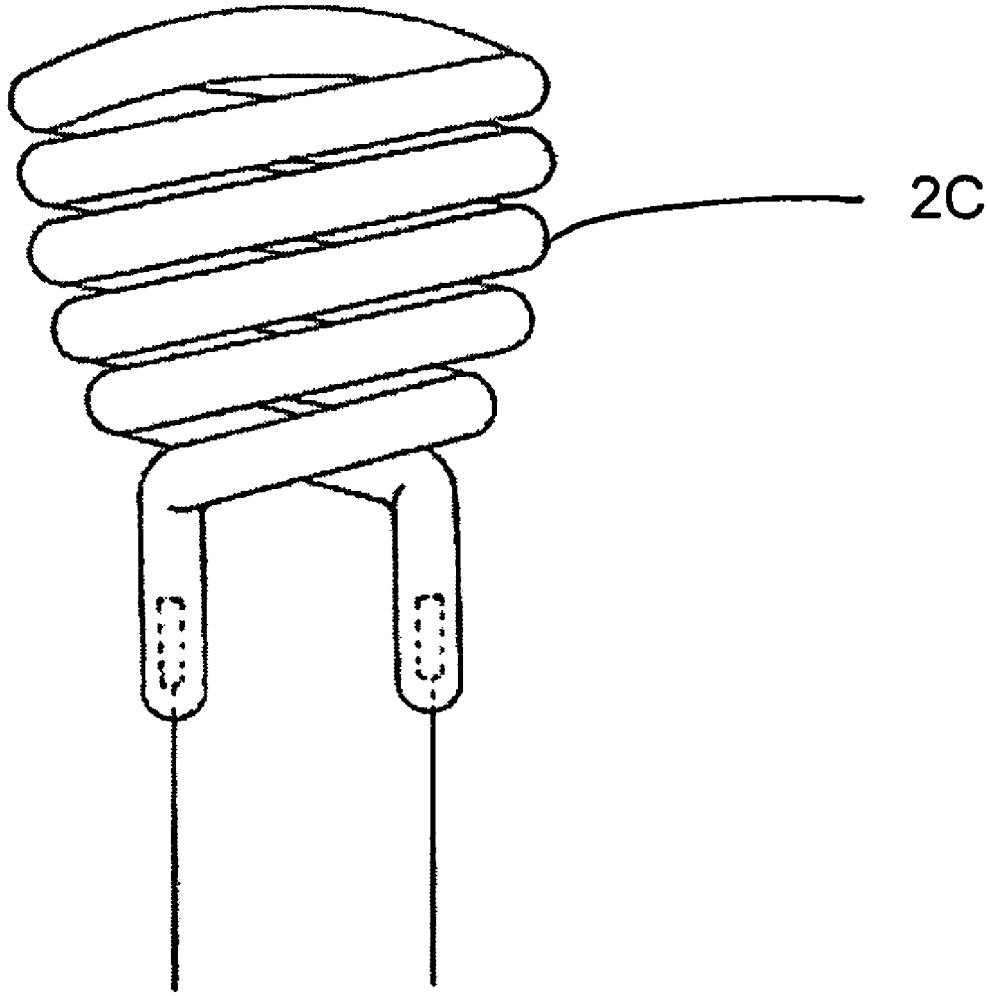
FIG. 10 is a perspective view of an alternative of light tube according to the preferred embodiment of the present invention.
Figure 11:
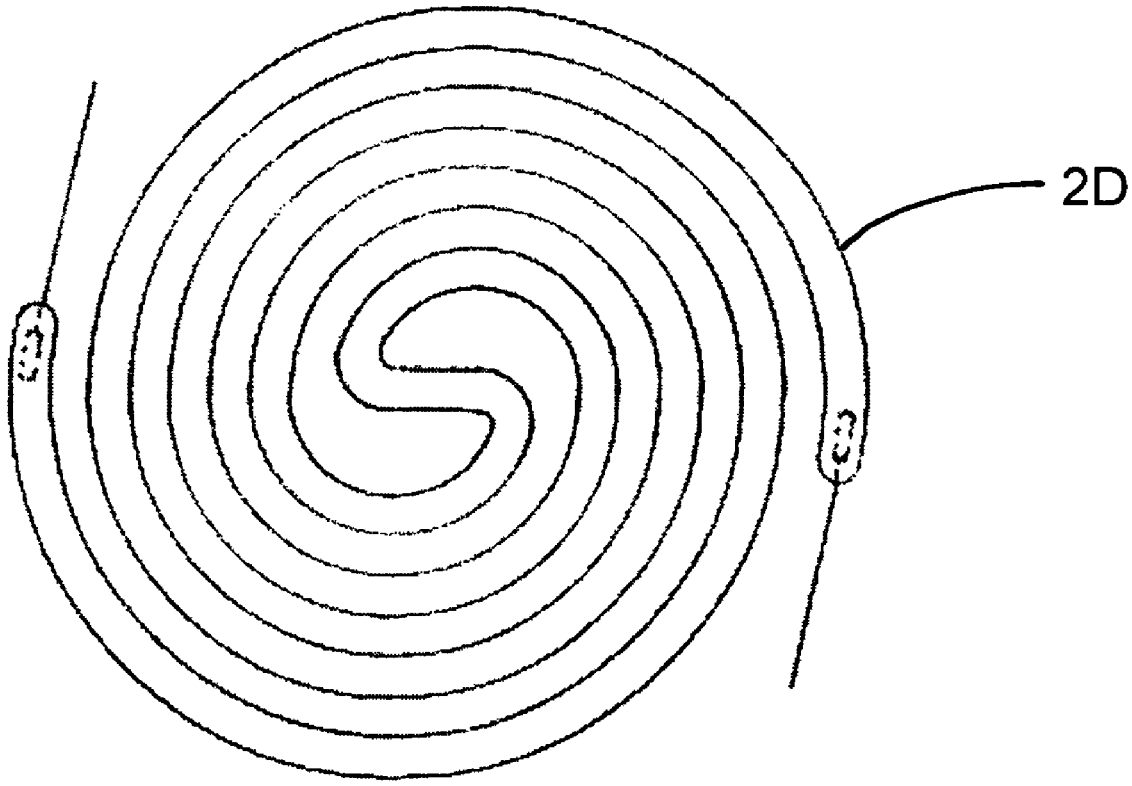
FIG. 11 is a perspective view of an alternative of light tube according to the preferred embodiment of the present invention.

Referring to FIGS. 8 through 11, various shapes of light tub are illustrated. In FIG. 8, the light tube 2A is shaped as a spiral with a constant area of cross-section along its longitudinal direction. In FIG. 9, as an alternative, the light tube 2B is shaped as a spiral with a wider bottom tapering vertically to the top. In FIG. 10, as an alternative, the light tube 2C is shaped as a spiral with a wider top tapering vertically to the bottom. In FIG. 11, as another alternative, the light tube 2D is made in a coil-shaped on a plan. The various shapes reduce the space occupied by the light tube 2 (2A–2D), thereby making the CCFL compact. In addition, the above-disclosed housing 1 can be transparent, milky or sand-polished for various effects of illumination.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A light tube for a cold electrode fluorescent lamp, comprising:

a light tube body having a first end portion, second end portion, and a spiral portion extended between said first and second end portions, wherein said light tube body contains an inert gas, a mercury substance and a layer of phosphor coated on an inner surface of said light tube body;

a first electrode, having an enlarged first surface area, disposed at said first end portion in said light tube body, adapted for connecting to a first terminal of electricity;

a second electrode, having an enlarged second surface area, disposed at said second end portion in said light tube body, adapted for electrically connecting to a second terminal of electricity for emitting electrons to excite said mercury substance for conducting said electrons to said first electrode as an electric loop, wherein said excited mercury substance emits ultra violet rays causing said phosphor coating to generate visible light; and an activated gas absorber, made of zirconium-vanadium-iron alloy, formed at each of said first and second electrodes at said first and second surface areas thereof for absorbing oxygenic gas within said light tube body, wherein said activated gas absorber is made from a zirconium-vanadium-iron gas absorber, which is activated at an activation temperature of 390 degrees Celsius, integrally coated on said surface area of said respective electrode to form an integral electrode.

2. The light tube, as recited in claim 1, wherein each of said first and second electrodes comprises a single layer plate defining said surface area thereon that said activated gas absorber is coated on said single layer plate.

3. The light tube, as recited in claim 1, wherein each of said first and second electrodes comprises a two-layer plate defining said surface area thereon that said activated gas absorber is coated on said two-layer plate.

4. The light tube, as recited in claim 1, wherein each of said first and second electrodes comprises a cylindrical tube defining said surface area thereon that said activated gas absorber is coated on said cylindrical tube.

5. The light tube, as recited in claim 1, wherein each of said first and second electrodes comprises a spiral member having a constant cross section along a longitudinal direction and defining said surface area thereon that said activated gas absorber is coated on said spiral member.

6. The light tube, as recited in claim 1, wherein each of said first and second electrodes comprises a spiral member having a cross section varying along a longitudinal direction and defining said surface area thereon that said activated gas absorber is coated on said spiral member.

7. A cold electrode fluorescent lamp for illumination, comprising:

a housing;

a base for supporting said housing, having a first terminal and a second terminal insulated from said first terminal for electrically connected to voltage;

a light tube, which is disposed in said housing, having a first end portion, a second end portion, and a spiral portion extended between said first and second end portions, wherein said light tube contains an inert gas, a mercury substance and a layer of phosphor coated on an inner surface thereof;

a first electrode, having an enlarged first surface area, disposed at said first end portion in said light tube, electrically connecting to said first terminal;

a second electrode, having an enlarged second surface area, disposed at said second end portion in said light tube, electrically connecting to said second terminal for emitting electrons to excite said mercury substance for conducting said electrons to said first electrode as an electric loop, wherein said excited mercury substance emits ultra violet rays causing said phosphor coating to generate visible light;

an igniter, which is disposed in said base, electrically connected to said first and second terminals, for driving said first and second electrodes to function; and an activated gas absorber, made of zirconium-vanadium-iron alloy, formed at each of said first and second electrodes at said first and second surface areas thereof for absorbing oxygenic gas within said light tube body, wherein said activated gas absorber is made from a zirconium-vanadium-iron gas absorber, which is activated at an activation temperature of 390 degrees Celsius, integrally coated on said surface area of said respective electrode to form an integral electrode.

8. The cold electrode fluorescent lamp, as recited in claim 7, wherein said housing further has an air passage communicating an interior of said housing with an exterior thereof for balancing an interior pressure of said housing and for dissipating heat from said light tube.

9. The cold electrode fluorescent lamp, as recited in claim 7, wherein said housing is sealedly mounted on said base for maintaining heat from said light tube.

10. The cold electrode fluorescent lamp, as recited in claim 8, wherein each of said first and second electrodes comprises a single layer plate defining said surface area thereon that said activated gas absorber is coated on said single layer plate.

11. The cold electrode fluorescent lamp, as recited in claim 9, wherein each of said first and second electrodes comprises a single layer plate defining said surface area thereon that said activated gas absorber is coated on said single layer plate.

12. The light tube, as recited in claim 8, wherein each of said first and second electrodes comprises a two-layer plate defining said surface area thereon that said activated gas absorber is coated on said two-layer plate.

13. The light tube, as recited in claim 9, wherein each of said first and second electrodes comprises a two-layer plate defining said surface area thereon that said activated gas absorber is coated on said two-layer plate.

14. The light tube, as recited in claim 8, wherein each of said first and second electrodes comprises a cylindrical tube defining said surface area thereon that said activated gas absorber is coated on said cylindrical tube.

15. The light tube, as recited in claim 9, wherein each of said first and second electrodes comprises a cylindrical tube defining said surface area thereon that said activated gas absorber is coated on said cylindrical tube.

16. The light tube, as recited in claim 8, wherein each of said first and second electrodes comprises a spiral member having a constant cross section along a longitudinal direction and defining said surface area thereon that said activated gas absorber is coated on said spiral member.

17. The light tube, as recited in claim 9, wherein each of said first and second electrodes comprises a spiral member having a constant cross section along a longitudinal direction and defining said surface area thereon that said activated gas absorber is coated on said spiral member.

18. The light tube, as recited in claim 8, wherein each of said first and second electrodes comprises a spiral member having a cross section varying along a longitudinal direction and defining said surface area thereon that said activated gas absorber is coated on said spiral member.

19. The light tube, as recited in claim 9, wherein each of said first and second electrodes comprises a spiral member having a cross section varying along a longitudinal direction and defining said surface area thereon that said activated gas absorber is coated on said spiral member.

* * * * *